United States Patent [19]

Munding et al.

[11] 4,301,875

[45] Nov. 24, 1981

[54] METHOD FOR MAKING HOLES AND PRODUCING GAS IN COAL SEAMS

[75] Inventors: German Munding, Bad Friedrichshall; Helmut Hopmann, Ottobrunn; Armin Sowa, Ottobrunn; Christian Beckervordersandforth, Aachen-Verlautenheide; Walter Terschuren, Aachen, all of Fed Rep. of Germany

[73] Assignee: Messerschmitt-Bölkow-Blohm GmbH, Fed. Rep. of Germany

[21] Appl. No.: 97,800

[22] Filed: Nov. 27, 1979

Related U.S. Application Data

[63] Continuation-in-part of Ser. No. 883,593, Mar. 6, 1978, abandoned.

[30] Foreign Application Priority Data

Mar. 4, 1977 [DE] Fed. Rep. of Germany ..... 2709437

[51] Int. Cl.[3] ..... E21C 43/00; E21C 43/243

[52] U.S. Cl. ..... 175/12; 48/DIG.6; 166/260; 175/14

[58] Field of Search ..... 175/12, 14, 13; 299/14, 299/3, 4, 5; 166/256, 261, 262, 259, 50, 260

[56] References Cited

U.S. PATENT DOCUMENTS

| | | | |
|---|---|---|---|
| 2,688,464 | 9/1954 | Payne | 175/12 |
| 2,786,660 | 3/1957 | Alleman | 166/50 X |
| 3,482,640 | 12/1969 | Browning | 175/14 |
| 3,917,007 | 11/1975 | Tsiferov | 175/14 |
| 4,010,801 | 3/1977 | Terry | 166/261 |
| 4,168,752 | 9/1979 | Sabol | 175/12 |

*Primary Examiner*—Ernest R. Purser

*Attorney, Agent, or Firm*—McGlew and Tuttle

[57] ABSTRACT

A method and apparatus for making holes in coal seams in a coal mining system in which hot working gas is employed to impinge on the coal under high pressure and speed in order to disintegrate it and particularly for making inclined or horizontal holes which connect vertical drill holes which lead from the surface to the coal seam and through which the medium for gasifying the coal underground is blown in. The vertical drill holes which lead from the coal seam to the surface are used for blowing out gasification gases which are produced by the operation as well as for delivering the hot working gas. With the method of the invention, a gasification medium of high temperature and pressure is advantageously produced directly at the locations where the disintegrated coal is gasified, the disintegrated coal being formed by a rocket combustion process. With the invention, a hydrogenating gasification medium is used for gasifying the coal seam, for example, a hydrogen steam or hydrogen steam mixture, so that the gas produced possesses the quality of natural gas. An oxidizing gasification medium such as air may also be supplied for gasifying the drillings. The resulting CO and $H_2O$ gases which are produced are further burned to $CO_2$ and $H_2O$ by the oxidizing gasification medium. The gasification medium is not supplied from the surface but is produced at the location at which the gasification takes place, for example, by injecting into the hot working gas, water or the like, carried along from a rocket combustion process. For the rocket combustion process, a fuel is chosen so that the resulting gas is capable of acting simultaneously as a gasification medium and working gas.

8 Claims, 3 Drawing Figures

METHOD FOR MAKING HOLES AND PRODUCING GAS IN COAL SEAMS

This is a Continuation in Part application of Ser. No. 883,593 filed Mar. 6, 1978, now abandoned.

FIELD AND BACKGROUND OF THE INVENTION

This invention relates to coal mining operations in general and, in particular, to a new and useful method of drilling holes in coal seams and for simultaneously gasifying coal in the seam.

DESCRIPTION OF THE PRIOR ART

For coal to be extracted from coal seams by underground gasification, it is well known to use hydraulic power for producing connecting ducts between vertical drill holes which are used for the extraction. In another known method of producing such connecting ducts, the coal between the vertical drill holes to be connected is heated electrically. The known methods of driving of the connecting ducts, however, involve considerable difficulties and costs, and, in addition, a risk of damaging the gastight overburden. Damage of the gastight overburden is considered disadvantageous because it results in an uncontrollable escape of the gasification medium and the produced gas. Moreover, a spacing of the order of magnitude of 60 m between the vertical drill holes to be connected to each other is the upper limit for applying the two known methods.

Consequently, if these methods of the prior art are applied, the exploitation of a coal seam by underground gasification requires a relatively dense system of vertical drill holes, entailing high costs.

The foregoing also applies to cases where the well known rotary drilling method is used for driving an inclined or horizontal connecting duct in the coal seam to be gasified underground, between a vertical drill hole for introducing a gasification medium and a vertical drill hole for blowing out the gas produced during the coal gasifying process. That is, the drilling equipment to be used for this purpose, namely, a drill head and a liquid turbine for driving the same, is relatively heavy. This heavy construction and the limited mobility resulting therefrom makes control of the tools particularly difficult. This explains why the maximum lengths of the connecting ducts produced by means of such drilling equipment are limited to about 50 m throughout. Also to be noted are the considerable expenses of supplying, in this case, the liquid turbine, with the operating fluid from the surface, and of removing the drillings, that is cut away particles of coal, to a location above the ground.

The required expensive transportation of the drillings to the surface is to be taken into account also in another known method of making horizontal holes by means of a dynamic rocket-type gas jet from a jet tube which is oriented and guided in the direction of the drive axis and held in a floating position relative to the wall of the hole.

SUMMARY OF THE INVENTION

The present invention is directed to a method of making holes in coal seams which, as compared to the prior art, is far better suited for producing, in particular, inclined or horizontal holes for connecting vertical drill holes, through which a gasification medium is blown in for underground coal gasification to vertical drill holes through which the gas produced during the gasification process is blown out to the surface.

For this purpose, and in accordance with the invention, it is provided that the disintegrated coal is brought into contact with a gasifying medium having an adequate temperature and pressure level on the very spot where the disintegrated coal is produced by the working gas.

With the inventive method, holes of exactly defined position and direction and much longer than that usual up to the present time, can be produced in coal seams in an economical manner, without having to take into account the risk of an uncontrolled damaging of the gastight overburden or any of the negative consequences thereof mentioned in the foregoing description of the prior art. It is of substantial importance in this connection that the inventive method is no longer dependent on a power supply from the surface, and that the disintegrated coal produced during the thermal drilling process, before being transported to the surface, are converted into gas, which appreciably simplifies this transportation. In consequence, nothing interferes with the possibility of creating, even in particularly deep coal deposits, a large system of connecting holes between vertical drill holes since, with the inventive method, they can now be spaced apart from each other by much greater distances than before and thus at locations best suitable for the gasification process. For example, the vertical holes may now be provided in drilling patterns with a module of 500 m and more. A comparison with up-to-date usual hole spacing, for the given reasons, of about 60 m at most, makes it clear the savings in vertical drill holes and expenses connected therewith which can be made during the exploitation by underground gasification of coal seams, particularly seams of large superficial extent.

Accordingly, it is an object of the invention to provide a method of making holes in coal seams while using a hot working gas which impinges on the coal with high pressure and speed to disintegrate the coal, particularly to form inclined or horizontal holes which connect vertical drill holes which lead from the surface to the coal seam, and through which the medium for gasifying the coal is blown in to vertical drill holes and the inclined or horizontal holes leading from the coal seam to the surface, through which the produced gas resulting from the coal gasification is blown out which comprises directing a gasification medium of high temperature and pressure into contact with the disintegrated coal to produce gases on the spot where the disintegrated coal is produced by the working gas to thereby gasify the coal seam and make the holes.

A further object of the invention is to provide a method of gasifying the disintegrated coal produced by a working gas on the spot by using a hydrogenating gasification medium which is produced at the location where the gasification takes place by injecting into the hot working gas, water or the like, carried along from a rocket combustion process or by providing a fuel for the rocket combustion process, of such a nature that the resulting gas is capable of acting simultaneously as a gasification medium and a working gas.

Another object of the invention is to provide a method of making holes in coal seams which is simple in concept and easy to carry out.

The various features of novelty which characterize the invention are pointed out with particularity in the claims annexed to and forming a part of this disclosure. For a better understanding of the invention, its operating advantages and specific objects attained by its uses, reference is made to the accompanying descriptive matter in which a preferred embodiment of the invention is illustrated.

DESCRIPTION OF THE PREFERRED EMBODIMENT

In order to gasify the drilling produced by the working gas on the spot, it is advisable to use a hydrogenating gasification medium, such as hydrogen steam or a hydrogen-steam mixture. With this provision, the gas produced during the gasification process possesses the quality of natural gas. The conditions are completely different, however, if as also may be provided, an oxidizing gasification medium, such as air is employed for gasifying the disintegrated coal. In such a case, primarily CO and $H_2O$ are formed during the gasification process at the coal, but to a larger extent, these primary gases are further burned to $CO_2$ and $H_2O$ by the oxidizing gasification medium.

The operation may be simplified by providing that the gasification medium is not supplied from the surface, but is produced directly at the location at which the gasification takes place. This may be done, for example, by injecting into the hot working gas, water or the like, carried along from a rocket combustion process, or by providing a fuel for the rocket combustion process of such a nature that the resulting gas is capable of acting simultaneously as the gasification medium and the working gas.

Finally, the advantageous possibility is given to abstain from a transportation to the surface of the gas obtained from the gasification of the disintegrated coal and to use this gas on the spot as a fuel for producing the working gas.

In accordance with the invention, the holes are made in coal seams while using a hot working gas which impinges on the coal with high pressure and speed to disintegrate the coal. The inventive method is particularly applicable for making horizontal holes for interconnecting the vertical holes which lead from the coal seam to the surface and through which the produced gas resulting from the coal gasification is blown out.

With the invention, the gasification medium of high temperature and pressure is directed into contact with the disintegrated coal to produce gases on the spot where the disintegrated coal is produced by the working gas to thereby gasify the seams and make the holes. The hot working gas which is formed in the seam is supplemented by an injection of rocket combustion gases which are produced advantageously directly at the spot.

Figure 1:
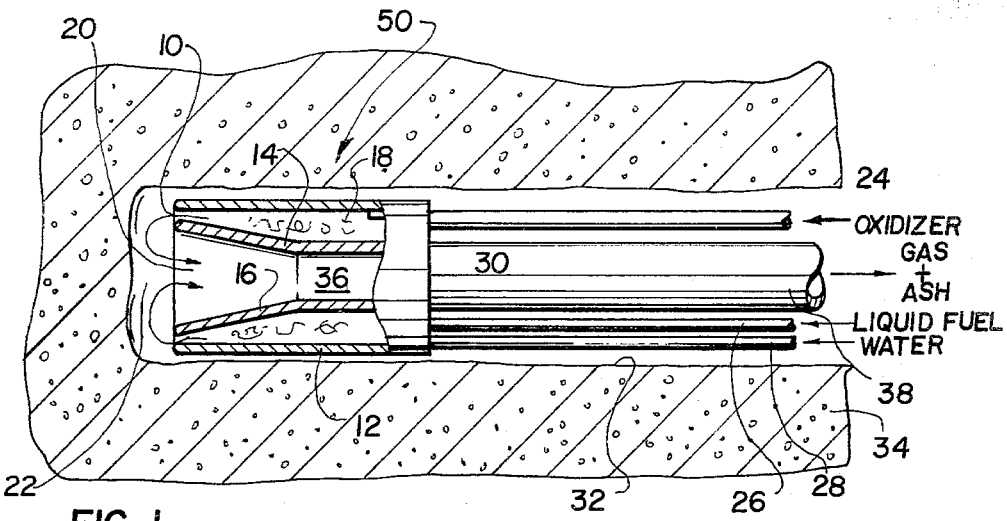
FIG. 1 is a sectional view of a hot gas drilling scraper device in accordance with the invention and used in the inventive method shown disposed within a coal seam.

Turning now to the figures, the invention as shown in FIG. 1 comprises a hot gas drilling scraper device generally designated 50 having an annular nozzle 10 formed between an outer cylindrical housing member 12 and an inner wall 14. Inner wall 14 includes a frusto-conical section which enlarges outwardly toward nozzle 10. Frusto-conical section 16 and outer cylindrical member 12 define a combustion chamber 18 therebetween. Radially inwardly of conical section 16 in scraper 50 is a reaction space 20 wherein disintegrated coal from a space 22 in advance of the scraper 50 reacts with gasifying gases to form desired products of the coal.

Air is supplied to reaction chamber 18 through an air line 24 and, in accordance with one embodiment of the invention, liquid fuel and water are supplied to the combustion chamber 18 through liquid fuel line 26 and water line 28. The combustion reaction in chamber 18 is self sustaining after the reaction is initiated by, for example, an ignition device 30 which may be a spark plug or the like. The hot products of combustion are forced under high pressure and temperature out of annular nozzle 10 and at the exposed face of coal in space 22 to disintegrate the coal. This forms a horizontal or inclined bore 32 through the coal seam 34.

The disintegrated coal enters reaction space 20 where it gasifies according, for example to the reaction:

$$C+H_2O \rightarrow CO+H_2 (+28.3 \text{ Kcal per mol})$$

According to another embodiment of the invention, the water line 28 can be deleted from the embodiment shown in FIG. 1 and the coal gasified according to the Boudouard reaction. The Boudouard reaction is:

$$C+CO_2 \rightarrow 2CO \ (+38.0 \text{ Kcal per mol})$$

The required $CO_2$ is provided by the products of combustion from combustion chamber 18 when the air and liquid fuel mixture is burned.

The hot gas drilling scraper 50 can be directed into a desired path through the coal seam 34 by selectively tensioning cables which suspend the scraper 50 for example, or by selectively tensioning the various lines for supplying the air, water or liquid fuel. The product gases plus a small quantity of ash are then directed from reaction space 20 through the central passage 36 of the scraper 50 and to the surface through a gas plus ash line 38.

Figure 2:
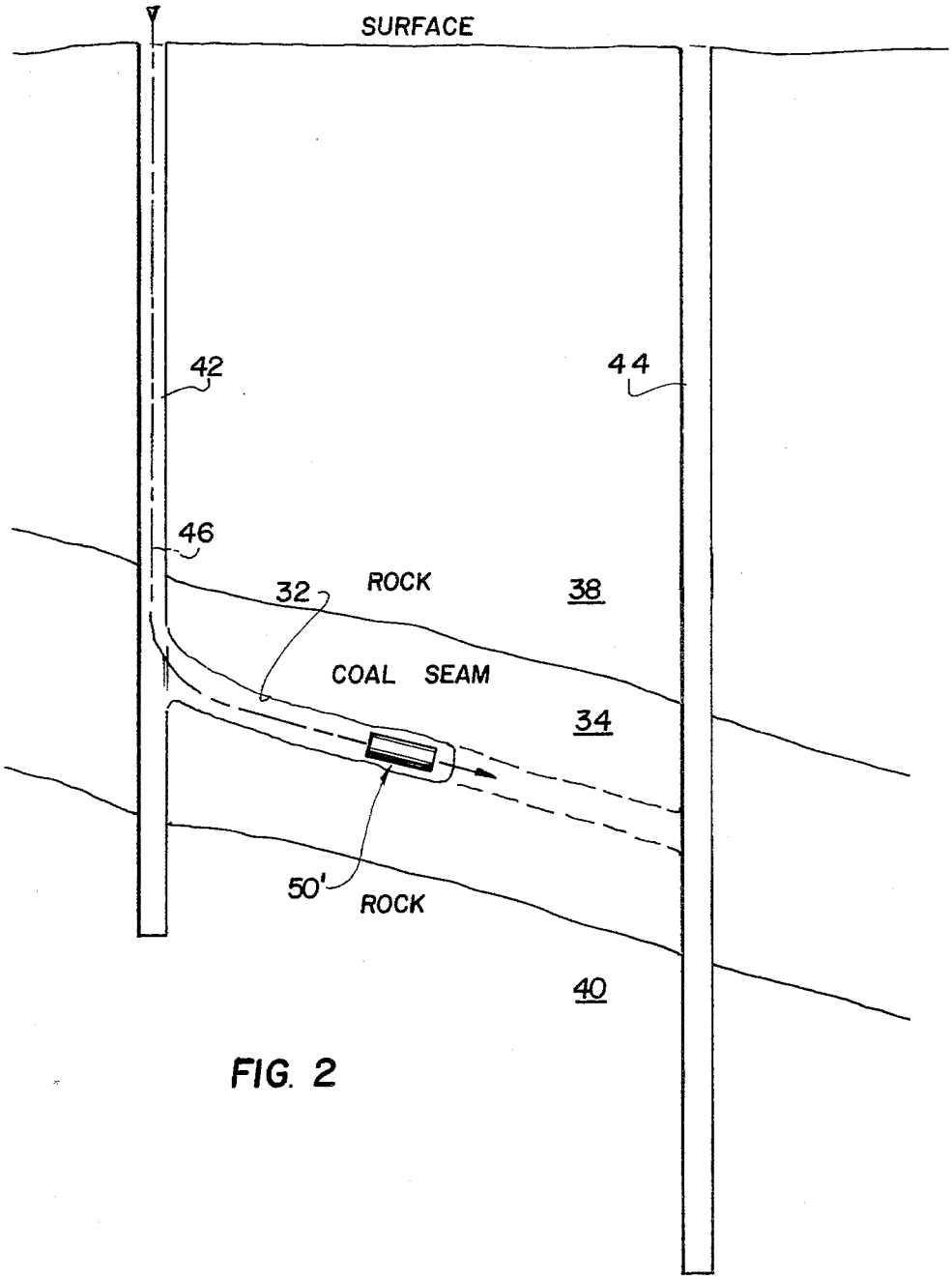
FIG. 2 is diagrammatical sectional view of a coal seam extending between two substantially vertical bore holes.

Turning to FIG. 2, a bore 32 is shown partially completed through coal seam 34. Coal seam 34 is shown in a cross section of earth sandwiched between two rock layers 38 and 40 respectively. Two substantially vertical bore holes 42 and 44 are shown which are spaced apart and comprise, for example, oil well bores from depleted to near depleted oil reservoirs. A hot gas drilling scraper 50' is shown suspended from a cable 46 or the like. In this embodiment of the invention, the drilling device 50' is self contained and starts from the first vertical bore hole 42 from which it enters the coal seam 34. Cable or cables 46 may be provided to properly aim the scraper device 50' toward the coal seam 34 and then, as coal is gasified out of the seam to form the bore 32, the scraper 50' can be fed forward by feeding cable or cables 46. Since the reactions of the invention are designed to form bores through coal seams and not through rock, no danger exists that a useless horizontal or inclined bore 32 is drilled through a rock layer rather than a coal seam.

Since the material to be disintegrated is coal, the removal of the products of the drilling operation, that is the disintegrated coal, are facilitated by the hot gas method in which the coal is gasified during the hot gas drilling operation. The products of the disintegrated coal is in the form of gas with a very small quantity of ash, which gas is predominantly methane. The methane may be supplied to the surface backwardly through the starting vertical bore 42 or used at the drilling cite to continue the combustion reaction and act as the hot gases for disintegrating the coal. Once bore 32 is completed through the seam 34, it enters bore 41 which is used to tap gasified coal which is gasified by gasification gases supplied to the top of starting bore 42.

Figure 3:
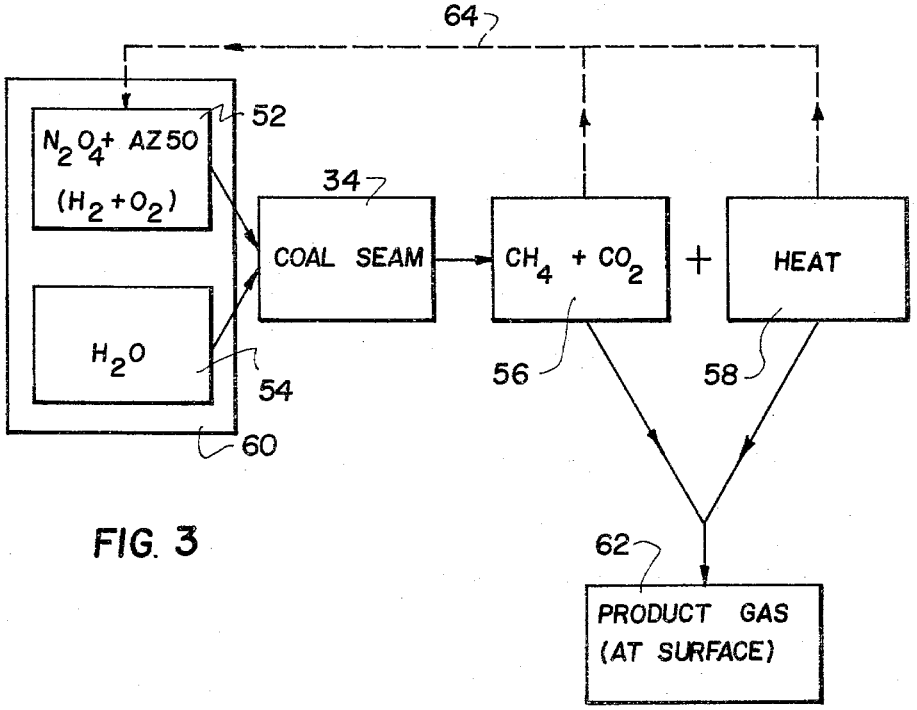
FIG. 3 is a block diagram showing an alternate embodiment of the inventive method.

FIG. 3 shows an alternate form of the invention which utilizes a reactive mixture from schematically shown reaction chamber 52 and water supplied from water supply 54 in a schematically shown hot gas drilling apparatus 60. These are directed against coal in a coal seam schematically shown at box 34 which forms products that are predominantly methane and carbon dioxide shown at box 56. Another product of this reaction is heat shown schematically at box 58 with the heat and the reaction products combining to form useful product gases which are fed to the surface at 62. In self contained reaction, some of the heat and methane with $CO_2$ can be supplied through an auxiliary line 64 back to the reaction chamber 52 to continue or control the reaction and excess products still being available at the surface 62.

While specific embodiments of the invention have been described and shown in detail to illustrate the application of the principles of the invention, it will be understood that the invention may be embodied otherwise without departing from such principles.

What is claimed is:

1. A method of making holes in coal seams particularly inclined and horizontal holes which connect vertical drill holes leading from the surface to the coal seam and through which a medium for gasifying the coal which is produced on the ground is blown into vertical drill holes leading from the coal seam to the surface and through which a produced gas results from the coal degasification is blown out, which comprises: directing a hot working gas toward the coal in a seam at high pressure and speed to disintegrate the coal; directing a gasification medium of high temperature and pressure into contact with the disintegrated coal to gasify the coal and form the produced gases on the spot where the disintegrated coal is disintegrated by the working gas to thereby make the holes; and directing the produced gases out of the holes.

2. A method of making holes in coal seams as claimed in claim 1, wherein a hydrogenating gasification medium, such as hydrogen steam or a hydrogen-steam mixture, is employed for gasifying the disintegrated coal on the spot where they are produced by the working gas.

3. A method of working holes in coal seams, as claimed in claim 1, wherein the gasification medium is produced directly at the location where the disintegrated coal is gasified.

4. A method of making holes in coal seams, as claimed in claim 1, wherein the gasification medium is used for gasifying the coal and also as a working gas for disintegrating coal.

5. A method of making holes in coal seams, as claimed in claim 1, wherein a combustion process is employed for producing the working gas and gasification medium.

6. A method of making holes in coal seams as claimed in claim 1, wherein a gas produced by the gasification of the disintegrated coal is used for producing the working gas.

7. A method of making holes in coal seams, as claimed in claim 1, including supplying a fuel and oxidizer to a combustion chamber having an annular nozzle facing coal in the coal seam, with a central chamber space; combusting the fuel and oxidizer to produce the hot working gas which direct the disintegrated coal into the central working space; the gasification medium being supplied through the nozzle to gasify the disintegrated coal in the central chamber space; and supplying the produced gases through a conduit communicating with the central chamber space.

8. A method of making holes in coal seams, as claimed in claim 1, wherein the hot working gas is produced by combustion of fuel from a rocket engine adjacent the coal to be disintegrated, to disintegrate the coal, the gasification medium supplied through the rocket engine for gasifying the disintegrated coal.

* * * * *